US008910605B2

(12) United States Patent
Adachi et al.

(10) Patent No.: US 8,910,605 B2
(45) Date of Patent: Dec. 16, 2014

(54) VALVE TIMING CONTROL DEVICE

(75) Inventors: Kazunari Adachi, Chiryu (JP); Yuji Noguchi, Obu (JP); Atsushi Homma, Kariya (JP); Takeo Asahi, Kariya (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 0 days.

(21) Appl. No.: 13/994,568

(22) PCT Filed: Jan. 23, 2012

(86) PCT No.: PCT/JP2012/051357

§ 371 (c)(1),
(2), (4) Date: Jun. 14, 2013

(87) PCT Pub. No.: WO2012/111389

PCT Pub. Date: Aug. 23, 2012

(65) Prior Publication Data

US 2013/0269638 A1 Oct. 17, 2013

(30) Foreign Application Priority Data

Feb. 18, 2011 (JP) ..... 2011-033814

(51) Int. Cl.
*F01L 1/34* (2006.01)
*F01L 1/356* (2006.01)
*F01L 1/344* (2006.01)

(52) U.S. Cl.
CPC ..... *F01L 1/34* (2013.01); *F01L 2001/34483* (2013.01); *F01L 1/3442* (2013.01); *F01L 1/356* (2013.01)
USPC ..... 123/90.17

(58) Field of Classification Search
CPC ..... F01L 1/344; F01L 1/3442
USPC ..... 123/90.6; 29/888.1
See application file for complete search history.

(56) References Cited

U.S. PATENT DOCUMENTS 6,450,138 B1 9/2002 Kinugawa et al.
8,028,667 B2 * 10/2011 Hayashi ..... 123/90.17

(Continued)

FOREIGN PATENT DOCUMENTS

JP 2006-183590 A 7/2006
JP 2007-278306 A 10/2007

(Continued)

OTHER PUBLICATIONS

Notification of Transmittal of Translation of the International Preliminary Report on Patentability (Form PCT/IB338), International Preliminary Report on Patentability (Form PCT/IB/373), Written Opinion on the International Searching Authority (Form PCT/ISA/237) mailed in corresponding International Patent Application No. PCT/JP2012/051357, Jan. 23, 2012, IB of WIPO, Geneva, Switzerland.

(Continued)

*Primary Examiner* — Thomas Denion
*Assistant Examiner* — Daniel Bernstein
(74) *Attorney, Agent, or Firm* — Buchanan Ingersoll & Rooney PC

(57) ABSTRACT

A valve timing control device includes a driving rotary element synchronously rotatable with a crankshaft; a driven rotary element mounted coaxially with the driving rotary element and synchronously rotatable with a camshaft; a plurality of partitions provided in the driven rotary element each for dividing a fluid pressure chamber formed between the driving rotary element and the driven rotary element into a regarded angle chamber and an advanced angle chamber; and a connecting element for connecting the driven rotary element to the camshaft. The connecting element includes a flange inserted into a recess formed in the driven rotatory element, and a shaft portion inserted into a through bore formed in a wall of the driving rotary element adjacent to the camshaft. The flange has an outer diameter larger than that of the shaft portion, and is disposed between the driven rotary element and the wall.

7 Claims, 6 Drawing Sheets

(56) References Cited

U.S. PATENT DOCUMENTS

| | | | | |
|---|---|---|---|---|
| 2006/0137635 | A1 | 6/2006 | Hayashi | |
| 2011/0168112 | A1 | 7/2011 | Noguchi et al. | |
| 2012/0132160 | A1 * | 5/2012 | Malen et al. | 123/90.15 |

FOREIGN PATENT DOCUMENTS

| | | | |
|---|---|---|---|
| JP | 2008-144590 | A | 6/2008 |
| JP | 2011-140929 | A | 7/2011 |
| WO | WO 01/55562 | A1 | 8/2001 |

OTHER PUBLICATIONS

International Search Report (PCT/ISA/210) issued on Apr. 24, 2012, by the Japanese Patent Office as the International Searching Authority for International Application No. PCT/JP2012/051357.

Written Opinion (PCT/ISA/237) issued on Apr. 24, 2012, by the Japanese Patent Office as the International Searching Authority for International Application No. PCT/JP2012/051357.

* cited by examiner

VALVE TIMING CONTROL DEVICE

TECHNICAL FIELD

The present invention relates to a valve timing control device including a driving rotary element synchronously rotatable with a crankshaft; a driven rotary element mounted coaxially with the driving rotary element and synchronously rotatable with a camshaft; and a plurality of partitions provided in the driven rotary element each for dividing a fluid pressure chamber formed between the driven rotary element and the driven rotary element into a regarded angle chamber and an advanced angle chamber.

BACKGROUND ART

When the driven rotary element is bolted to the camshaft, the fastening pressure applied to the driven rotary element is increased because of a small contacting area between the camshaft and the driven rotary element. In general, an aluminum material of low rigidity is often used for manufacturing the driven rotary element, and thus the driven rotary element is easily deformed.

Under the circumstances, a connecting element is disposed between the driven rotary element and the camshaft. This increases the contacting area between the camshaft and the driven rotary element to reduce a pressing force exerted upon the driven rotary element per unit area, as a result of which the deformation of the driven rotary element can be prevented.

Various parts are manufactured in various component facilities and delivered to an assembly shop to assemble the driven rotary element to the camshaft. The driven rotary element, the driving rotary element and the connecting element of all the components are manufactured in the same component facility and delivered as an assembled unit. The connecting element is press-fitted to a recess formed in one side of the driven rotary element and delivered as an integrated unit. Such an integrated configuration advantageously alleviates the trouble in delivery and facilitates the assembling work of the camshaft.

On the other hand, when the connecting element is press-fitted to the recess of the driven rotary element, only the surface of the driven rotary element provided with the recess is enlarged in diameter, as a result of which the entire driven rotary element may disadvantageously be deformed outward of the surface in a direction opposite to the recess. As a measure for overcoming such a disadvantage, Japanese Unexamined Patent Application Publication No. 2006-183590 discloses a technique for forming a recess for receiving the connecting element press-fittingly in the driven rotary element and also forming a recess for receiving a bushing press-fittingly in the back side of the driven rotary element (see PTL 1). This balances the degrees of deformation in diameter in both the surfaces of the element and prevents the driven rotary element from deforming outward of the surface.

CITATION LIST

Patent Literature

PTL 1: Japanese Unexamined Patent Application Publication No. 2006-183590

SUMMARY OF INVENTION

However, in the technique disclosed in PTL 1, the degrees of deformation in diameter in both the surfaces of the driven rotary element are not necessarily canceled with each other due to, for example, a dimensional error in the bushing, the connecting element, or the recesses. As a result, the outward surface deformation may still be observed in the driven rotary element. This technique requires a step for press fitting the bushing in addition to the step for press fitting the connecting element. Therefore, not only the number of components is increased to lead to troublesome working, but also the outward surface deformation of the driven rotary element cannot be reliably prevented. Hence, the conventional technique noted above cannot be regarded as a rational art for providing the valve timing control device.

The object of the present invention is to provide a valve timing control device enabling simplification of the manufacturing process and reduction of the number of parts while suppressing deformation of the driven rotary element.

A first characteristic feature of the valve timing control device according to the present invention lies in comprising a driving rotary element synchronously rotatable with a crankshaft; a driven rotary element mounted coaxially with the driving rotary element and synchronously rotatable with a camshaft; a plurality of partitions provided in the driven rotary element each for dividing a fluid pressure chamber formed between the driving rotary element and the driven rotary element into a regarded angle chamber and an advanced angle chamber; and a connecting element for connecting the driven rotary element to the camshaft, wherein the connecting element includes a flange inserted into a recess formed in the driven rotatory element, and a shaft portion inserted into a through bore formed in a wall of the driving rotary element adjacent to the camshaft, the flange has an outer diameter larger than that of the shaft portion, and the flange is disposed between the driven rotary element and the wall.

With the above-noted arrangement, the flange provided in the connecting element has an outer diameter larger than that of the shaft portion, and is disposed between the driven rotary element and the wall, thereby to allow the flange to be held between the driven rotary element and the wall. This can prevent the connecting element from falling off when the driven rotary element, the driving rotary element and the connecting element are assembled together. As a result, it becomes quite easy to deliver the unit with those three components being assembled.

Further, since the flange of the connecting element does not apply pressure to the driven rotary element in the radial direction, no deformation occurs in the driven rotary element.

In addition, since no force is applied to the driven rotary element in the radial direction, any bushing does not need to be press-fitted in the opposite side to the connecting element.

Consequently, the above-noted arrangement facilitates assembling of the driven rotary element, the driving rotary element and the connecting element and cuts down on the number of parts, which can provide a rational valve timing control device having a simple construction.

A second characteristic feature of the valve timing control device according to the present invention lies in the flange includes a plurality of fitting segments spaced apart from each other along a rotational direction to fit to an inner circumference of the recess, and a radially extending centerline of at least one of the fitting segments does not overlap any of the partitions.

In general, the driven rotary element includes a cylindrical portion formed adjacent a rotational center thereof and a plurality of partitions circumferentially provided at intervals in an outer circumference of the cylindrical portion. When the connecting element is press-fitted to such a driven rotary element in connecting the camshaft, the driven rotary element is inevitably deformed more or less.

Providing the centerline of a specific fitting segment radially overlaps any one of the partitions, a contact portion of the driven rotary element coming into contact with the fitting segment is deformed radially outward. With such deformation, the partition associated with the contact portion is also enlarged in diameter. Here, the driven rotary element is deformed only at the side adjacent to the recess, and thus the partition moves to the opposite side to the recess and deforms. As the partition has a predetermined radial dimension, the deformation of the partition at an end thereof becomes great.

In order to eliminate such a disadvantage, according to the second characteristic feature of the present invention, at least one of the plurality of fitting segments formed in the connecting element is arranged so as not to radially overlap the corresponding partition of the driven rotary element. With such an arrangement, even if the cylindrical portion of the driven rotary element is deformed and enlarged in diameter, no partition is present radially outward of the deformed portion, and thus no outward deformation of the partition occurs. In this manner, it is possible to minimize the outward surface deformation of the driven rotary element by diminishing the number of the partitions radially corresponding to the fitting segment.

A third characteristic feature of the valve timing control device of the present invention lies in that all of the radially extending centerlines of the fitting segments are configured not to overlap any of the partitions.

With the above-noted arrangement in which all of the radially extending centerlines of the fitting segments are configured not to overlap any of the partitions, any of the partitions is not influenced by or is influenced a little by the deformation of the driven rotary element caused by the pressing of the fitting segments. More particularly, the deformation of the driven rotary element caused by the pressing of the fitting segments becomes a maximum on the centerlines of the fitting segments extending in the radial direction. Thus, the deformation of the driven rotary element as a whole can be a minimum by arranging the centerlines of the fitting segments so as not to overlap the partitions.

A fourth characteristic feature of the valve timing control device of the present invention lies in that all of the fitting segments are configured not to radially overlap any of the partitions other than the partition that is provided with at least one of a contact portion coming into contact with the driving rotary element for limiting relative movement between the driving rotary element and the driven rotary element and a lock mechanism for locking the driving rotary element and the driven rotary element in a predetermined rotational phase.

In general, at least one of the partitions of the driven rotary element is provided with the lock mechanism for locking the driving rotary element and the driven rotary element in the predetermined relative phase, or the contact portion coming into contact with the driving rotary element when the driven rotary element is rotated to the most advanced angle side or the most regarded angle side to limit further relative movement therebetween. When the lock mechanism is provided, the partition having the lock mechanism becomes larger than the remaining partitions in circumferential dimension because a lock pin should be provided. Similarly, when the contact portion is provided, the partition having the contact portion becomes larger than the remaining partitions in circumferential dimension because the contact portion should stand a shock of contact. As a result, the rigidity of the partition having the lock mechanism or the contact portion becomes greater than that of the remaining partitions. The partition that is provided with the lock mechanism or the like and having high rigidity is referred to as a high-rigidity partition, while the remaining partitions having low rigidity are referred to as low-rigidity partitions hereinafter.

In the arrangement having the fourth characteristic feature, none of the fitting segments agree with the low-rigidity partitions. If any of the fitting segments agrees with the high-rigidity partition or low-rigidity partition in the radial direction, the outward surface deformation caused by the radial agreement between the fitting segment and the low-rigidity partition is greater than the outward surface deformation caused by the radial agreement between the fitting segment and the high-rigidity partition. Thus, the outward surface deformation can be minimized by the arrangement in which none of the fitting segments corresponds to the low-rigidity partition.

A fifth characteristic feature of the present invention lies in that at least one of the plurality of fitting segments is configured to radially overlap the partition that is provided with at least one of the contact portion and the lock mechanism.

With the above-noted arrangement, the fitting segment agrees with the high-rigidity partition if it is unavoidable that any of the fitting segments radially agrees with any of the partitions. As a result, the outward surface deformation can be minimized even if somewhat deformation inevitably occurs, thereby to suppress overall deformation of the driven rotary element as much as possible.

A sixth characteristic feature of the present invention lies in providing a sprocket provided to be coplanar with the wall for receiving power from the crankshaft.

The shaft portion of the connecting element axially supports the wall of the driving rotary element. Thus, the rotational force exerted upon the sprocket is transmitted to the side surface of the connecting element through the wall. In this, if a plane where the sprocket is formed is positioned away from a plane where the wall is present, an external force is exerted from the sprocket to the driving rotary element for inclining the driving rotary element relative to a rotational axis. As a result, a frictional force between the driven rotary element and the driving rotary element may disadvantageously be increased, or the function born by the shaft portion of the connecting element for axially supporting the wall may be impaired.

In the above-noted arrangement in which the sprocket is provided to be coplanar with the wall, a direction of the force exerted on the shaft portion of the connecting element agrees with a direction perpendicular to the axis of the camshaft. As a result, the function of the shaft portion for axially supporting the wall is satisfactorily achieved to provide a reliable valve timing control device.

A seventh characteristic feature of the present invention lies in providing a guide mechanism for guiding and positioning the driven rotary element and the connecting element in the predetermined rotational phase.

With the above-noted arrangement, the driven rotary element and the connecting element can be guided and positioned in the predetermined rotational phase through the guide mechanism, which facilitates the positioning of the driven rotary element and the connecting element.

DESCRIPTION OF EMBODIMENTS

First Embodiment

Figure 5:
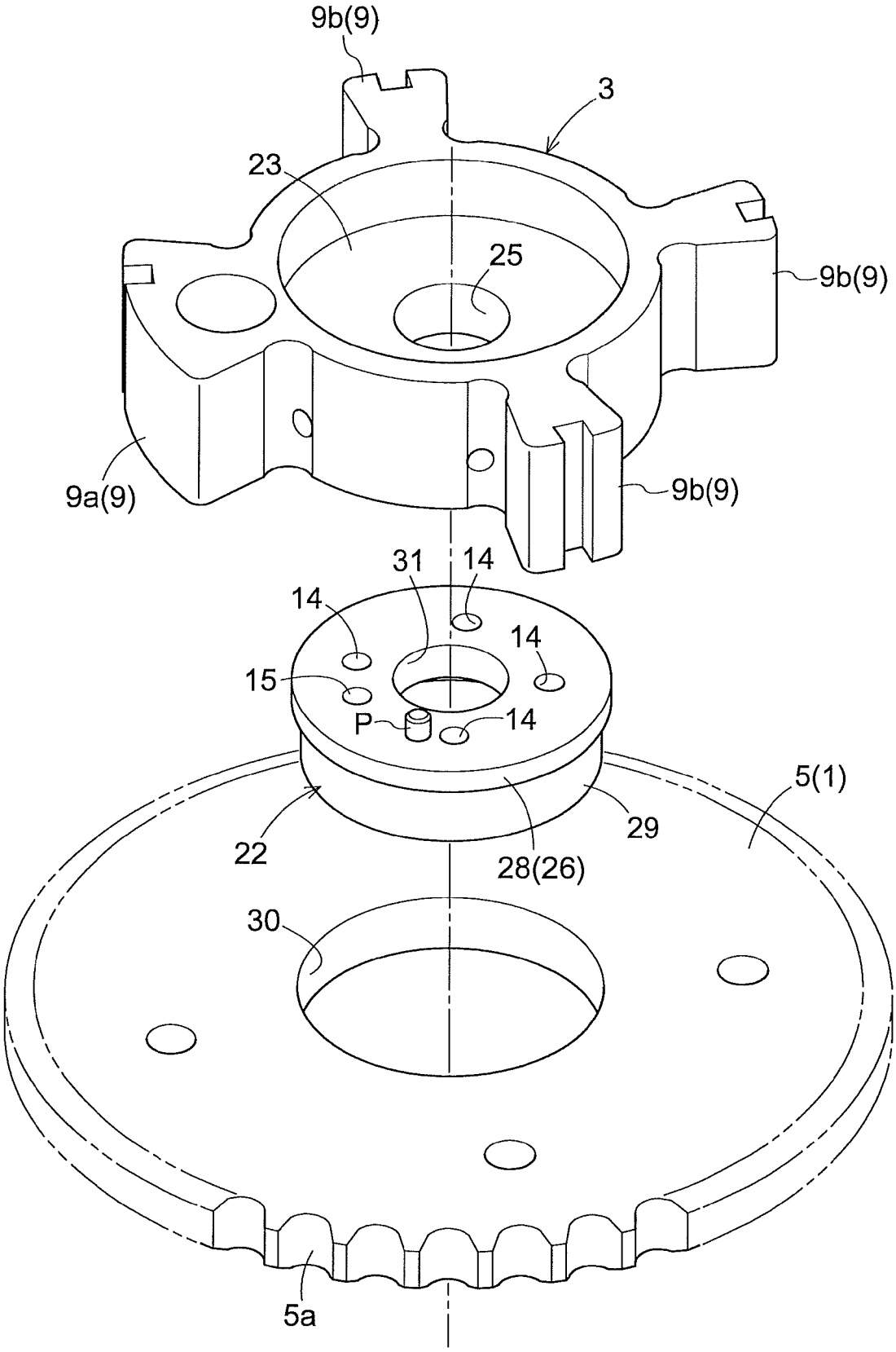
FIG. 5 is an exploded perspective view of the valve timing control device according to the first embodiment of the present invention.

A valve timing control device according to an embodiment of the present invention that is applied to an automobile engine will be described hereinafter in reference to FIGS. 1 and 5.

[Overall Configuration]

Figure 1:
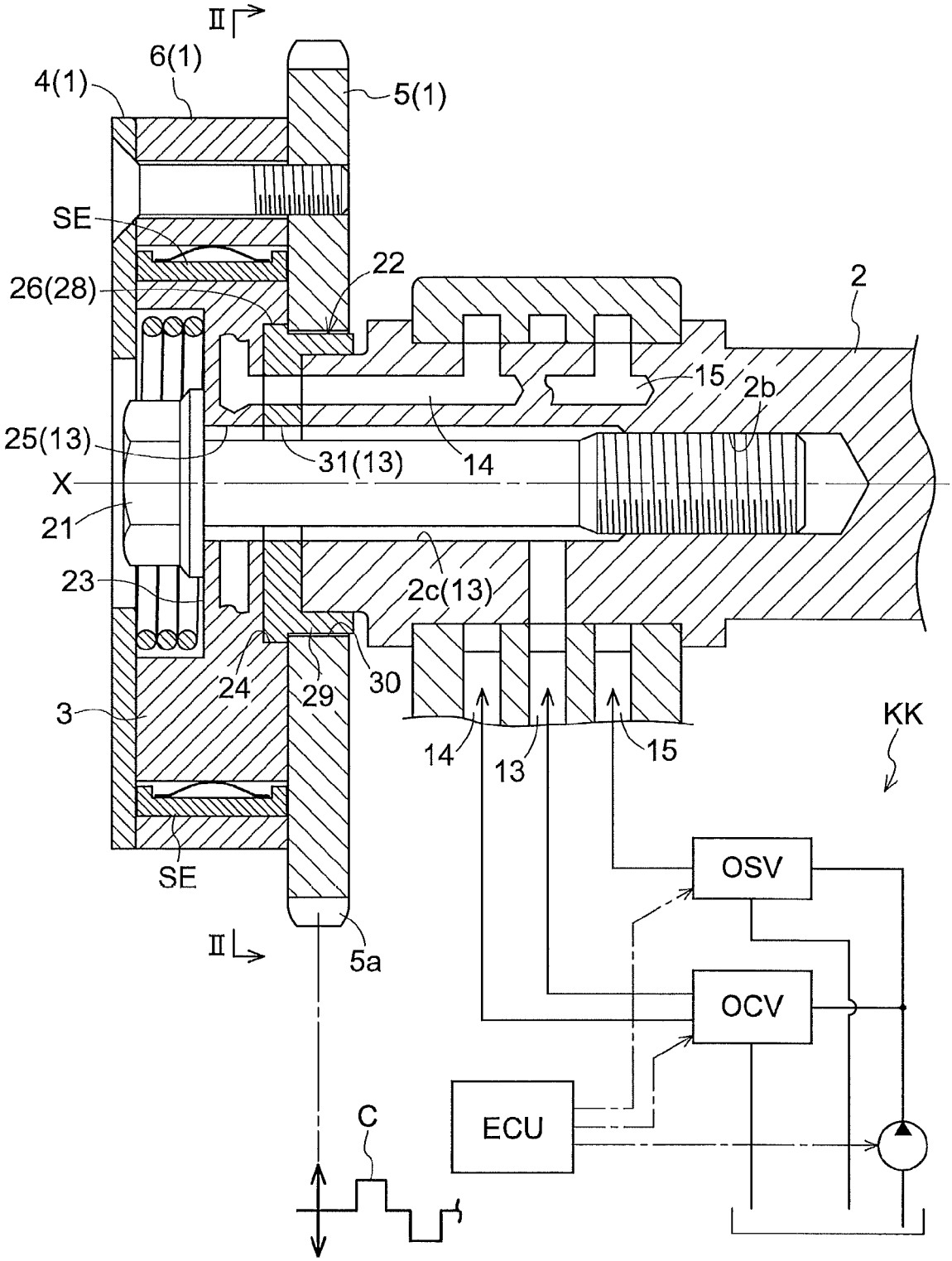
FIG. 1 is an overall view of a valve timing control device according to a first embodiment of the present invention.

Referring to FIG. 1, the valve timing control device is provided with a steel housing 1 (an example of a driving rotary element) that is synchronously rotatable with a crankshaft C of an engine, and an aluminum inner rotor 3 (an example of a driven rotary element) that is synchronously rotatable with a camshaft 2 of the engine. The housing 1 and the inner rotor 3 are coaxially arranged on an axis X.

[Housing and Rotor]

Referring to FIGS. 1 to 4, the housing 1 includes a front plate 4 mounted on a front side thereof opposite to the camshaft 2, a wall 5 mounted on a rear side thereof adjacent to the camshaft 2, and an outer rotor 6 mounted between the front plate 4 and the wall 5. The front plate 4, wall 5 and outer rotor 6 are fixedly screwed. A sprocket 5*a* is provided in an outer circumference of the wall 5 for receiving power from a crankshaft C. Here, the housing 1 may be integrally formed as a unit instead of fixedly screwing the front plate 4, the wall 5 and the outer rotor 6 together. Further, a sprocket 5*a* may be provided at an outer circumference of the outer rotor 6.

Figure 2:
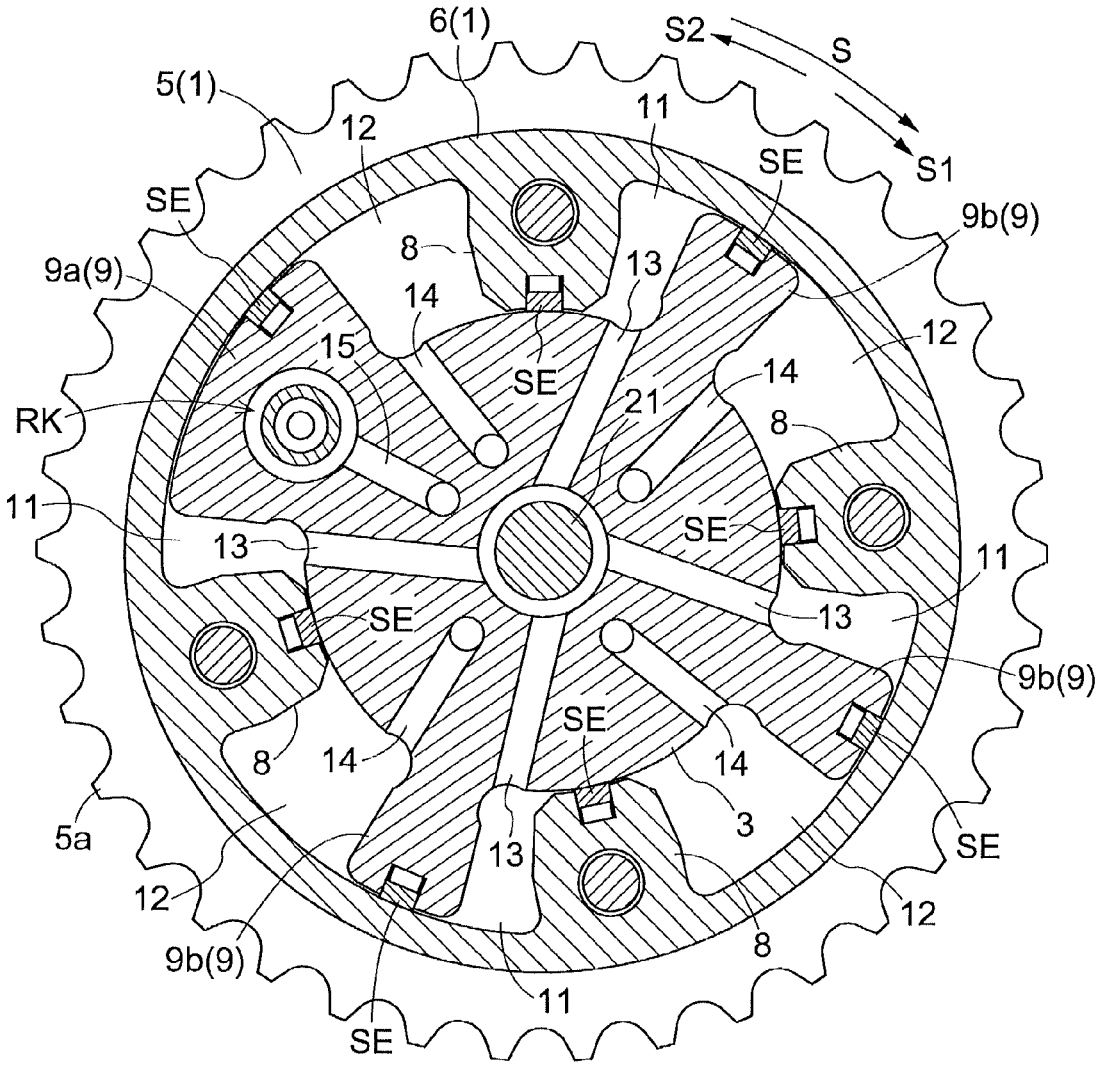
FIG. 2 is a cross-sectional view of the valve timing control device as viewed along arrows II-II of FIG. 1.

When the crankshaft C is rotated, a rotational driving force is transmitted to the wall 5 through a power transmission mechanism (not shown) such as a chain to rotate the outer rotor 6 in a rotational direction S (see FIG. 2). As the outer rotor 6 is rotated, the inner rotor 3 is rotated in the rotational direction S to rotate the camshaft 2 through oil in an advanced angle chamber 11 and a retarded angle chamber 12. Then, a cam (not shown) provided in the camshaft 2 operates an intake valve of the engine.

Figure 4:
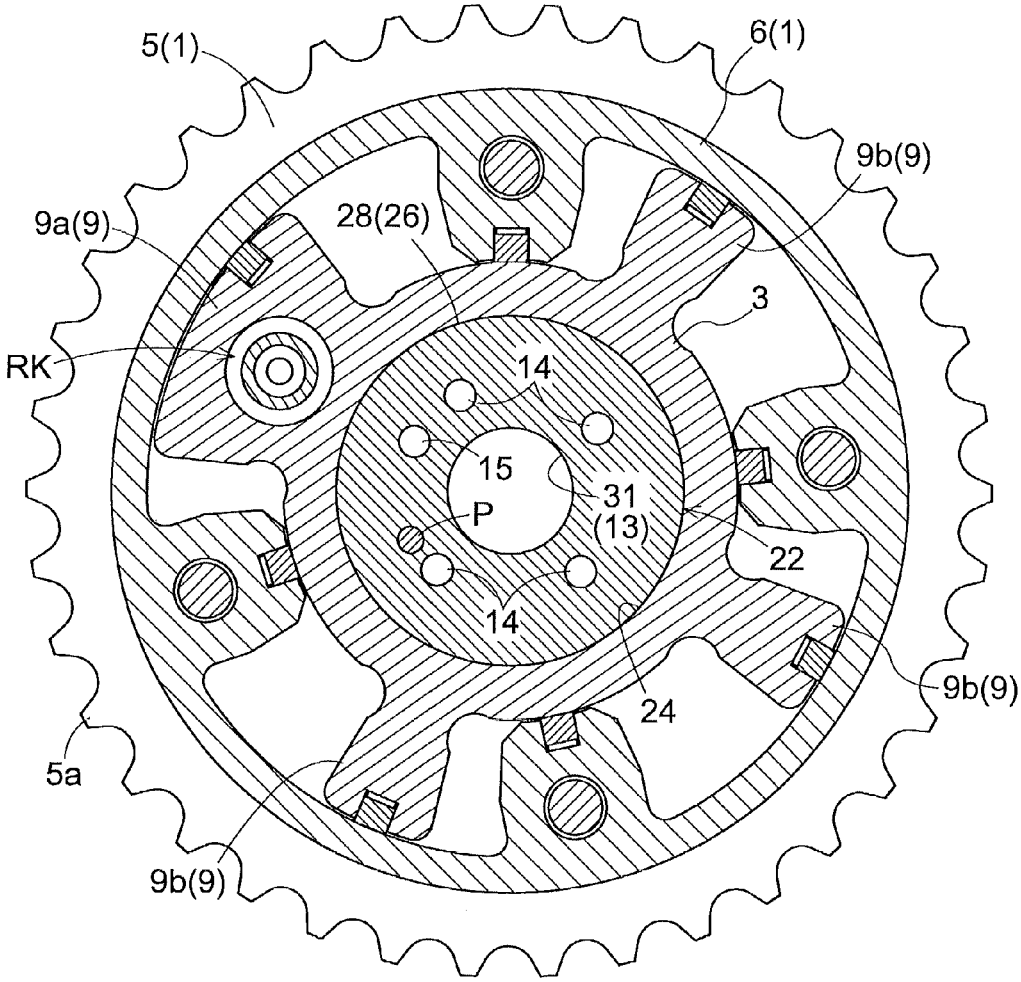
FIG. 4 is a cross-sectional view of the valve timing control device as viewed along arrows IV-IV of FIG. 3.

As shown in FIGS. 2 and 4, a plurality of first partitions 8 project inward in a radial direction from an inner circumference of the outer rotor 6. The first partitions 8 are spaced apart from each other along the rotational direction S. A plurality of second partitions 9 project outward in the radial direction from an outer circumference of the inner rotor 3. The second partitions 9 are also spaced apart from each other along the rotational direction S in the same manner as the first partitions 8. The first partitions 8 are configured to divide space between the outer rotor 6 and the inner rotor 3 into a plurality of fluid pressure chambers. The second partitions 9 are configured to divide each of the fluid pressure chambers into the advanced angle chamber 11 and the retarded angle chamber 12. In order to prevent leakage of engine oil between the advanced angle chamber 11 and the regarded angle chamber 12, sealing elements SE are provided in positions of the first partitions 8 opposed to the outer circumference of the inner rotor 3 and in positions of the second partitions 9 opposed to the inner circumference of the outer rotor 6, respectively.

Referring to FIGS. 1 and 2, within the inner rotor 3, a connecting element 22 and the camshaft 2 are formed an advanced angle passage 13 for connecting each advanced angle chamber 11 to a feed/discharge mechanism KK for allowing and intercepting feed or discharge of engine oil, a retarded angle passage 14 for connecting each regarded angle chamber 12 to the feed/discharge mechanism KK, and a lock passage 15 for connecting the feed/discharge mechanism KK to a lock mechanism RK for locking the inner rotor 3 and the outer rotor 6 in a predetermined relative rotational phase.

The feed/discharge mechanism KK includes an oil pan, an oil motor, a fluid control valve OCV for allowing and intercepting feed or discharge of engine oil to/from the advanced angle passage 13 and the retarded angle passage 14, a fluid switch valve OSV for allowing and intercepting feed or discharge of engine oil to/from the lock passage 15, and an electric control unit ECU for controlling operation of the fluid control valve OCV and fluid switch valve OSV. As the feed/discharge mechanism KK is controlled, the relative rotational phase of the inner rotor 3 and outer rotor 6 is displaced in an advanced angle direction (arrow S1 in FIG. 2) or a regarded angle direction (arrow S2 in FIG. 2) or is maintained in a desired phase.

[Connecting Mechanism Between Inner Rotor And Camshaft]

Referring to FIGS. 1 to 5, the inner rotor 3, the connecting element 22 and the camshaft 2 are fastened through a bolt 21. The bolt 21 is fastened to a female screw 2*b* formed in the back of a receiving bore 2*c* formed in an extreme end of the camshaft 2. With such an arrangement, the inner rotor 3 is integrally assembled to the extreme end of the camshaft 2 through the connecting element 22.

More particularly, a first hollow 23 for accommodating the head of the bolt 21 is formed in a front side of the inner rotor 3. On the other hand, a second hollow 24 (an example of a recess) is formed in a rear surface of the inner rotor 3 for receiving a flange 26 of the connecting element 22. A through bore 25 is formed between the first hollow 23 and the second hollow 24 for receiving the bolt 21. The flange 26 may be press-fitted to the second hollow 24.

The flange 26 formed in the front side of the connecting element 22 has an outer diameter greater than an outer diameter of a shaft portion 29 formed in the rear side of the connecting element 22. The rear surface of the inner rotor 3 is flush with the rear surface of flange 26 when the flange 26 is inserted into the second hollow 24. Further, when the shaft portion 29 is inserted into a round bore 30 of the wall 5 to secure the wall 5 to the outer rotor 6, the rear surface of the inner rotor 3 and the rear surface of the flange 26 come into tight contact with a front surface of a circumference of the round bore 30 of the wall 5. In short, the flange 26 is held between the inner rotor 3 and the wall 5.

Therefore, it is not required to press fit a bushing to the bore in addition to the connecting element 22 as disclosed in PTL 1, and the connecting element 22 can be prevented from falling off by contact between the rear surface of the flange 26 and the wall 5. In addition, since the element 22 does not deform the inner rotor 3 to be radially enlarged as in the technique disclosed in PTL 1, no outward surface deformation occurs in the inner rotor 3. Moreover, the separate bushing is dispensable and thus the number of parts can be reduced. In the actual assembling process, only simple working for inserting the flange 26 into the hollow of the inner rotor 3 to insert the shaft portion 29 to the round bore 30 of the wall 5, which can simplify the working process.

Unlike the above-described arrangement, even if the flange 26 should be press-fitted to the second hollow 24 of the inner rotor 3 for the sake of convenience in the assembling process, the flange 26 can be press-fitted to the second hollow 24 by a minimum necessary degree since the contact between the flange 26 and the wall 5 can be expected in a finished product. Thus, the outward surface deformation of the inner rotor 3 can be avoided or minimized.

The shaft portion 29 of the connecting element 22 has a function to axially support the wall 5. The sprocket 5*a* is formed in the outer periphery of the wall 5. A force inputted to the sprocket 5*a* is transmitted to the shaft portion 29 of the connecting element 22 through the wall 5. Here, if a plane where the sprocket 5*a* is formed is positioned away from a plane where the wall 5 is present, an external force is exerted from the sprocket 5*a* to the outer rotor 6 for inclining the outer rotor 6 relative to a rotational axis. As a result, a frictional force between the outer rotor 6 and the inner rotor 3 may disadvantageously be increased, or the function born by the shaft portion 29 of the connecting element 22 for axially supporting the wall 5 may be impaired.

In the arrangement shown in FIG. 1 in which the sprocket 5*a* is provided to be coplanar with the wall 5, a direction of the force exerted on the shaft portion 29 of the connecting element 22 agrees with a direction perpendicular to the axis of the camshaft 2. As a result, the function of the shaft portion 29 for axially supporting the wall 5 is satisfactorily achieved to provide a reliable valve timing control device.

The connecting element 22 has an opening 31 formed in a front surface thereof for receiving the bolt 21, and a recess 32 formed in a rear surface thereof for receiving the extreme end of the camshaft 2. A front pin-receiving hole 3*a* is formed in the inner rotor 3, a rear pin-receiving hole 2*a* is formed in the extreme end of the camshaft 2, and an intermediate pin-receiving hole 22*a* is formed in the connecting element 22, respectively. A gap between the through bore 25 of the inner rotor 3 and the bolt 21, a gap between the opening 31 of the connecting element 22 and the bolt 21, and a gap between the receiving bore 2*c* of the camshaft 2 and the bolt 21 act together as the advanced angle passage 13.

Figure 3:
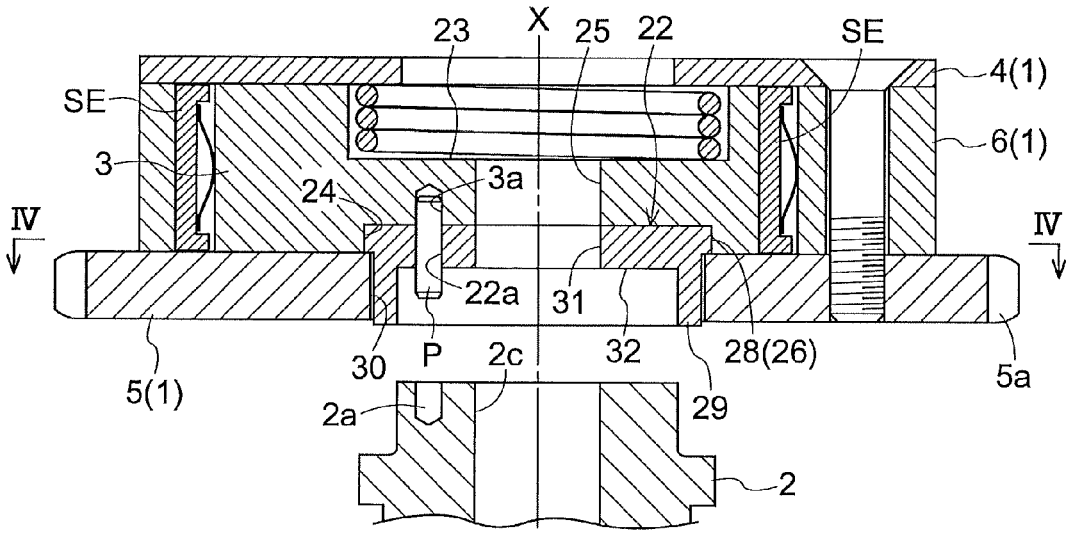
FIG. 3 is a cross-sectional view of a principal portion of the valve timing control device according to the first embodiment of the present invention.

As illustrated in FIG. 3, a pin P is inserted into the pin-receiving hole 3*a* of the inner rotor 3 and the pin-receiving hole 22*a* of the connecting element 22 to press fit the front part 26 of the connecting element 22 to the second hollow 24 of the inner rotor 3. Then, the pin P advances into the pin-receiving hole 2*a* formed in the extreme end of the camshaft 2 to insert the extreme end of the camshaft 2 to the recess 32 of the connecting element 22. As a result, the inner rotor 3, the connecting element 22 and the extreme end of the camshaft 2 are positioned in the predetermined relative rotational phase, thereby to form the advanced angle passage 13, the retarded angle passage 14 and the lock passage 15.

More particularly, the pin P and the pin-receiving holes 3*a* and 22*a* act as a guide mechanism together for allowing the inner rotor 3 and the connecting element 22 to be positioned in the predetermined relative rotational phase. The inner rotor 3 and the connecting element 22 are guided and positioned in the predetermined rotational phase through the guide mechanism (pin P and pin-receiving holes 3*a* and 22*a*). This facilitates the positioning of the inner rotor 3 and the connecting element 22.

Second Embodiment

Figure 6:
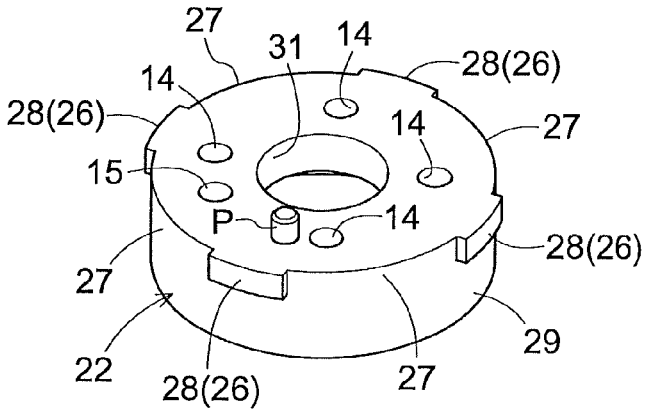
FIG. 6 is a perspective view of a connecting element according to a second embodiment.
Figure 7:
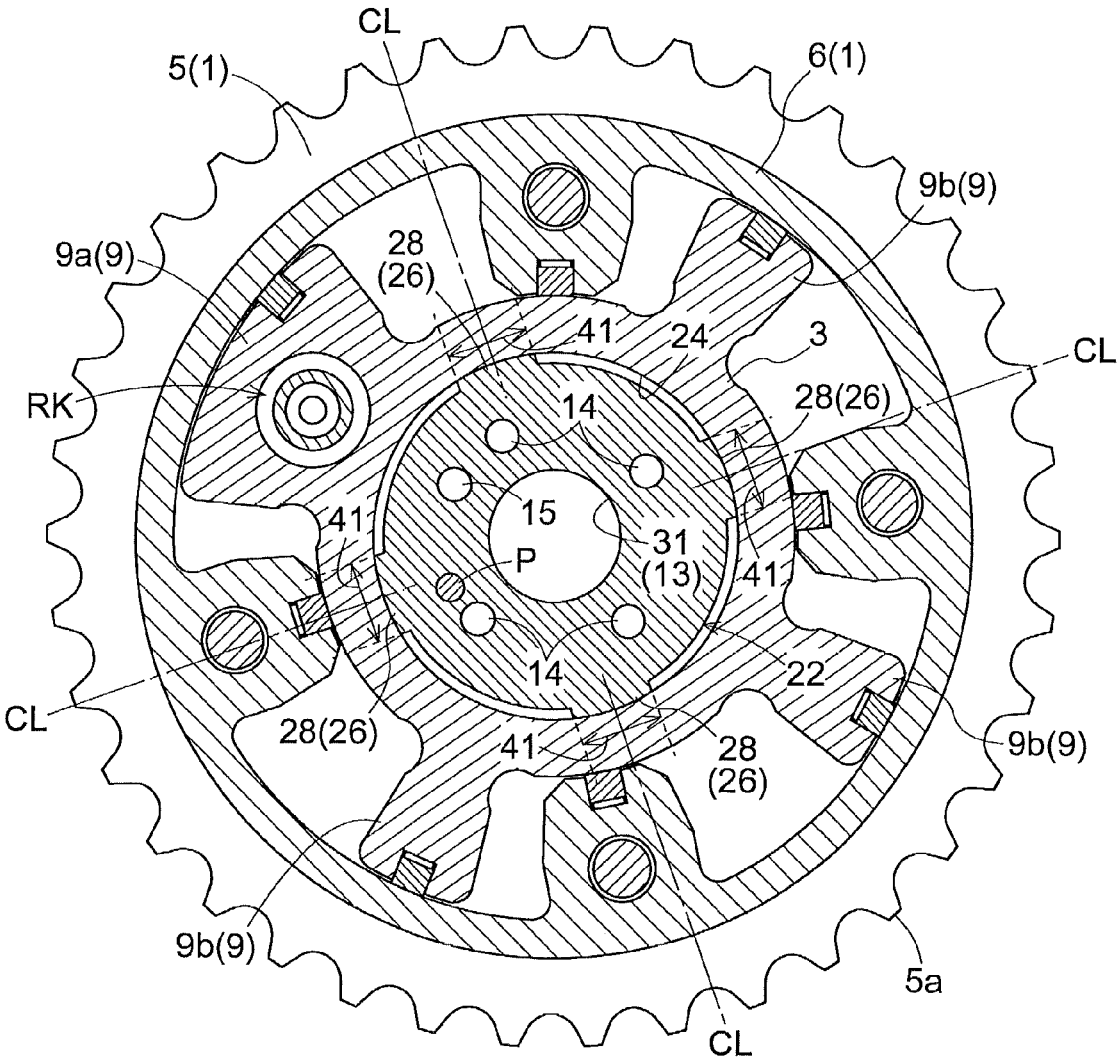
FIG. 7 is a cross-sectional view of a valve timing control device according to the second embodiment of the present invention.

Referring to FIGS. 6 and 7, a plurality of fitting segments 28 are formed in the connecting element 22. The fitting segments 28 are formed at intervals in an inner circumference of the second hollow 24 along the rotational direction S. For example, the phase of the adjacent fitting segments 28 has an angle of 90 degrees about the rotational axis. Further, a cut-away segment 27 is defined between the adjacent fitting segments 28.

[Positional Relationship Between Fitting Segment and Second Partition]

As shown in the arrangement shown in FIG. 7, none of the fitting segments 28 may overlap any of the second partitions 9, for example. When the connecting element 22 is press-fitted into the second hollow 24, the portions of the inner rotor 3 corresponding to the fitting segments are somewhat deformed to be radially enlarged, but are not associated with any of the second partitions 9. Thus, none of the second partitions 9 are deformed in corners. As a result, the outward surface deformation of the whole inner rotor 3 can be minimized. In addition, fitted segments 41 in the inner rotor 3 are all deformed to the same extent, which can prevent eccentricity of the inner rotor 3.

While FIG. 7 shows the configuration in which none of the fitting segments 28 overlap the second partitions 9, it is sufficient that at least one of the fitting segments 28 does not overlap the corresponding second partition 9. This is because the deformation of the inner rotor 3 can be a minimum since the portion where the fitting segment 28 does not overlap the corresponding second partition 9 has no influence on the change of the posture of the second partition 9.

In the present invention, it is not that all of the fitting segments 28 should never radially overlap the corresponding second partitions 9. More particularly, the second partitions 9 may be arranged so as not to overlap centerlines CL of the respective fitting segments 28 extending in the radial direction. In such an arrangement, the deformation of the inner rotor 3 caused by the pressing of the fitting segments 28 becomes a maximum on the centerlines CL of the fitting segments 28 extending in the radial direction. Thus, the outward surface deformation of the whole inner rotor 3 can be minimized by arranging the second partitions 9 so as not to overlap the centerlines of the fitting segments 28. In the construction of the present invention in which the centerlines CL of all the fitting segments 28 extending in the radial direction are arranged so as not to overlap the corresponding second partitions 9 in the radial direction, any of the second partitions 9 is not influenced by or is influenced a little by the deformation of the inner rotor 3 caused by the pressing of the fitting segments 28.

Third Embodiment

Figure 8:
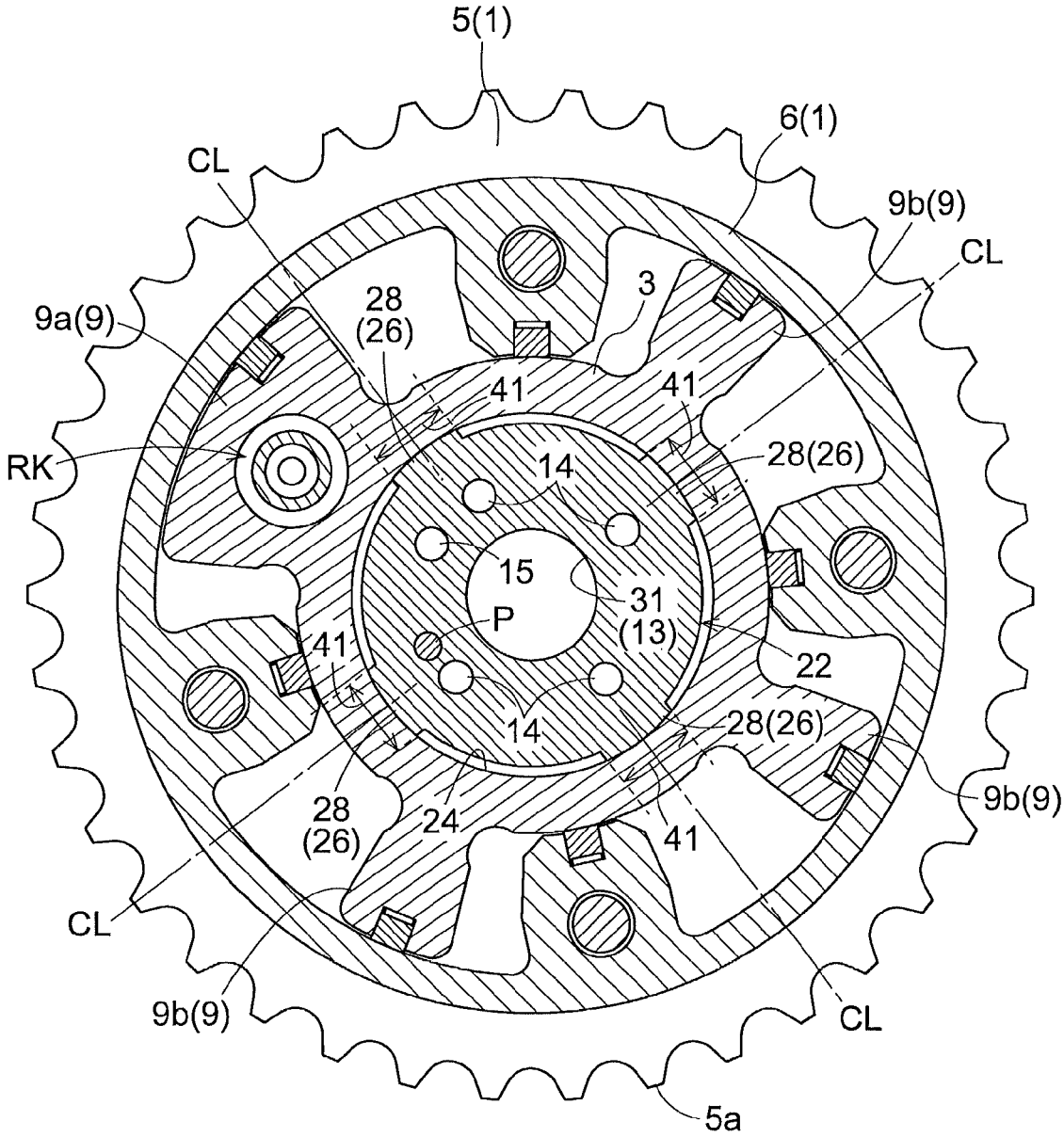
FIG. 8 is a perspective view of a valve timing control device according to a third embodiment.

Referring to FIG. 8, part of the fitting segments 28 overlaps the second partition 9 that is provided with the lock mechanism RK of the plurality of second partitions 9 in the radial direction, and the remaining fitting segments 28 do not overlap the second partitions 9 that are not provided with the lock mechanism RK. The second partition 9 that is provided with the lock mechanism RK is greater than the remaining second partitions 9 in circumferential dimension and rigidity because the lock pin should be provided. Thus, the second partition 9 that is provided with the lock mechanism RK is referred to as a high-rigidity partition 9*a*, while the remaining second partitions are referred to as low-rigidity partitions 9*b* hereinafter.

In the embodiment shown in FIG. 8, while three fitting segments 28 can be arranged so as not to overlap any of the second partitions 9, one fitting segment 28 inevitably overlaps any of the second partitions 9. In such a case, the high-rigidity partition 9*a* is selected as the second partition 9 to overlap.

More particularly, the high-rigidity partition 9*a* is not much subject to the influence of the pressing of the connecting element 22 because of its high rigidity. Therefore, the outward surface deformation in the corresponding fitted segment 41 is diminished, which results in the minimal overall deformation of the inner rotor 3. The fitted segments 41 fitted to the remaining three fitting segments 28 are formed in cylindrical portions of the inner rotor 3. Thus, while the cylindrical portions are deformed by the pressing of the fitting segments 28, such deformation has no influence on any of the low-rigidity partitions 9*b*.

In the third embodiment, only one fitting segment 28 radially overlaps the high-rigidity partition 9*a* that is provided with the lock mechanism RK. Instead, a plurality of the fitting segments 28 may overlap one high-rigidity partition 9*a*. Alternatively, a plurality of the high-rigidity partitions 9*a* may correspond to the plurality of fitting segments 28, respectively. In any case, the above-described effect of suppressing the deformation of the inner rotor 3 can be achieved.

The present invention is applicable to a valve timing control device for an internal combustion engine of an automobile, for example.

The invention claimed is:

1. A valve timing control device comprising:

a driving rotary element synchronously rotatable with a crankshaft;

a driven rotary element mounted coaxially with the driving rotary element and synchronously rotatable with a camshaft;

a plurality of partitions provided in the driven rotary element each for dividing a fluid pressure chamber formed between the driving rotary element and the driven rotary element into a retarded angle chamber and an advanced angle chamber; and a connecting element for connecting the driven rotary element to the camshaft, wherein the connecting element includes a flange inserted into a recess formed in the driven rotary element, and a shaft portion inserted into a through bore formed in a wall of the driving rotary element adjacent to the camshaft, the flange has an outer diameter larger than an outer diameter of the shaft portion and an inner diameter of the through bore, and the flange is disposed outside the through bore and between the driven rotary element and the wall, and is in contact with a surface of a circumference of the through bore and with an inner periphery of the recess.

2. The valve timing control device as defined in claim 1, wherein the flange includes a plurality of fitting segments spaced apart from each other along a rotational direction to fit to an inner circumference of the recess, and a radially extending centerline of at least one of the fitting segments does not overlap any of the partitions.

3. The valve timing control device as defined in claim 1, wherein all of the radially extending centerlines of the fitting segments are configured not to overlap any of the partitions.

4. The valve timing control device as defined in claim 1, wherein all of the fitting segments are configured not to radially overlap any of the partitions other than the partition that is provided with at least one of a contact portion coming into contact with the driving rotary element for limiting relative movement between the driving rotary element and the driven rotary element and a lock mechanism for locking the driving rotary element and the driven rotary element in a predetermined rotational phase.

5. The valve timing control device as defined in claim 4, wherein at least one of the plurality of fitting segments is configured to radially overlap the partition that is provided with at least one of the contact portion and the lock mechanism.

6. The valve timing control device as defined in claim 1, further comprising a sprocket provided to be coplanar with the wall for receiving power from the crankshaft.

7. The valve timing control device as defined in claim 1, further comprising a guide mechanism for guiding and positioning the driven rotary element and the connecting element in the predetermined rotational phase.

* * * * *